US009689282B2

(12) United States Patent
Choi et al.

(10) Patent No.: US 9,689,282 B2
(45) Date of Patent: Jun. 27, 2017

(54) VARIABLE VALVE LIFT APPARATUS

(71) Applicant: Hyundai Motor Company, Seoul (KR)

(72) Inventors: Myungsik Choi, Seoul (KR); Won Gyu Kim, Seoul (KR); Young Hong Kwak, Suwon-si (KR); Gee Wook Shin, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/798,078

(22) Filed: Jul. 13, 2015

(65) Prior Publication Data

US 2016/0138439 A1 May 19, 2016

(30) Foreign Application Priority Data

Nov. 14, 2014 (KR) ..... 10-2014-0158773

(51) Int. Cl.
*F01L 1/34* (2006.01)

(52) U.S. Cl.
CPC ..... *F01L 1/34* (2013.01)

(58) Field of Classification Search
CPC ..... F01L 1/34
USPC ..... 123/90.16
See application file for complete search history.

(56) References Cited

U.S. PATENT DOCUMENTS 6,705,259 B1 * 3/2004 Sellnau ..... F01L 1/08 123/90.16
7,207,300 B2 4/2007 Ezaki et al.
7,926,455 B2 * 4/2011 Manther ..... F01L 1/185 123/90.16
2004/0237919 A1 * 12/2004 Haas ..... F01L 1/182 123/90.16
2007/0006837 A1 * 1/2007 Seitz ..... F01L 1/185 123/90.39

FOREIGN PATENT DOCUMENTS

| | | | |
|---|---|---|---|
| JP | 10-212913 | A | 8/1998 |
| JP | 2001-289017 | A | 10/2001 |
| JP | 2008-184962 | A | 8/2008 |
| JP | 4292147 | B2 | 4/2009 |
| KR | 10-2007-0050368 | A | 5/2007 |
| KR | 10-1370717 | B1 | 3/2014 |

* cited by examiner

*Primary Examiner* — Zelalem Eshete

(74) *Attorney, Agent, or Firm* — Morgan Lewis & Bockius LLP

(57) ABSTRACT

A variable valve lift apparatus that changes a lift of a valve in an engine may include an outer body selectively pivoting based on rotation of a cam, having a first end configured to be connected with a valve and a second end mounted with a pivot shaft, and having an internal space formed in the outer body, an inner body pivoting based on rotation of the cam, disposed in the internal space of the outer body, and having a first end rotatably connected to the first end of the outer body, a connecting shaft disposed through the first end of the outer body and the first end of the inner body and connecting the outer body and the inner body to each other, and a lost motion spring having a portion fixed to the outer body and another portion fixed to the inner body.

8 Claims, 4 Drawing Sheets

VARIABLE VALVE LIFT APPARATUS

CROSS-REFERENCE TO RELATED APPLICATION

The present application claims priority to Korean Patent Application No. 10-2014-0158773 filed Nov. 14, 2014, the entire contents of which is incorporated herein for all purposes by this reference.

BACKGROUND OF THE INVENTION

Field of the Invention

The present invention relates to a variable valve lift apparatus. More particularly, the present invention relates to a three-point supported variable valve lift apparatus that is supported on two valves and one hydraulic lash adjuster.

Description of Related Art

In general, internal combustion engines generate power by receiving and burning air and fuel in a combustion chamber. When an intake valve is operated by a camshaft, air is drawn into the combustion chamber with the intake valve open. Further, when an exhaust valve is operated by the camshaft, air is discharged from the combustion chamber with the exhaust valve open.

The optimum operation of the intake valve or the exhaust valve depends on the RPM of the engine. That is, appropriate timing for lifting or opening/closing the valves is controlled on the basis of the RPM of the engine. In order to appropriately operate valves in accordance with the RPM of an engine, as described above, a VVL (Variable Valve Lift) apparatus that operates valves at different lifts in accordance with the RPM of an engine has been studied. As an example of the variable valve lift apparatus, there is an apparatus that includes a plurality of cams on a camshaft for operating valves at different lifts, and is operated such that the cams for operating the valves are selected in accordance with circumstances.

However, when a plurality of cams is provided on a camshaft, a configuration for switching the cams to operate an intake valve or an exhaust valve is complicated and there may be interference between components. On the other hand, when a plurality of cams is independently operated to prevent interference between components, components for operating the cams are additionally required, so the manufacturing cost may be increased.

The above information disclosed in this Background section is only for enhancement of understanding of the background of the invention and therefore it may contain information that does not form the prior art that is already known in this country to a person of ordinary skill in the art.

BRIEF SUMMARY

Various aspects of the present invention are directed to providing a variable valve lift apparatus having advantages of being able to change valve lifts with one cam, capable of deactivating a cylinder by changing a valve lift, and a variable valve lift apparatus that more efficiently uses a space and has improved dynamic characteristics, even changing lifts of two valves.

According to various aspects of the present invention, a variable valve lift apparatus that changes a lift of a valve in an engine may include an outer body selectively pivoting based on rotation of a cam, having a first end configured to be connected with a valve and a second end mounted with a pivot shaft, and having an internal space formed in the outer body, an inner body pivoting based on rotation of the cam, disposed in the internal space of the outer body, and having a first end rotatably connected to the first end of the outer body, a connecting shaft disposed through the first end of the outer body and the first end of the inner body and connecting the outer body and the inner body to each other, and a lost motion spring having a portion fixed to the outer body and another portion fixed to the inner body, in which the inner body may be configured to pivot with the outer body on a pivot shaft of the outer body while being selectively fixed to the outer body, or configured to pivot on the connecting shaft while being selectively detached from the outer body, and the lost motion spring returns the inner body that has pivoted on the connecting shaft relative to the outer body.

The variable valve lift apparatus may further include a roller that is disposed in an internal space of the inner body, is rotatably connected to the inner body, and is in rolling contact with the cam so that the inner body pivots with rotation of the cam.

A stopper of the inner body that protrudes to be locked to the second end of the outer body when the inner body is returned by the lost motion spring after pivoting may be formed at a second end of the inner body.

A portion of the lost motion spring may extend without interference with the inner body and may be fixed to the first end of the outer body.

Valve contact portions that protrude to both sides in a width direction of the outer body and are configured to come in contact with a valve may be formed at the first end of the outer body.

A hydraulic lash adjuster may be disposed at the second end of the outer body, and the outer body may be configured to be supported at three points by two valves being in contact with the valve contact portions at both sides and the hydraulic lash adjuster.

The outer body and the connecting shaft may be integrally formed, and a portion of the lost motion spring may be fixed to the outer body by being fixed to the connecting shaft.

The lost motion spring may be disposed so as to be wound around the connecting shaft.

The inner body further may include a stopper, inner connecting holes, roller holes, and a latching pin hole.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
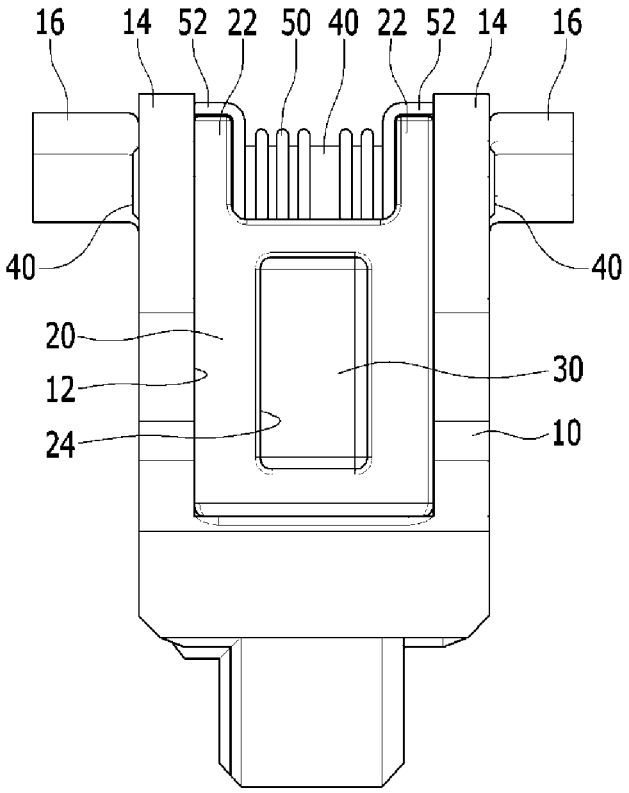
FIG. 1 is a top plan view of an exemplary variable valve lift apparatus according to the present invention.
Figure 2:
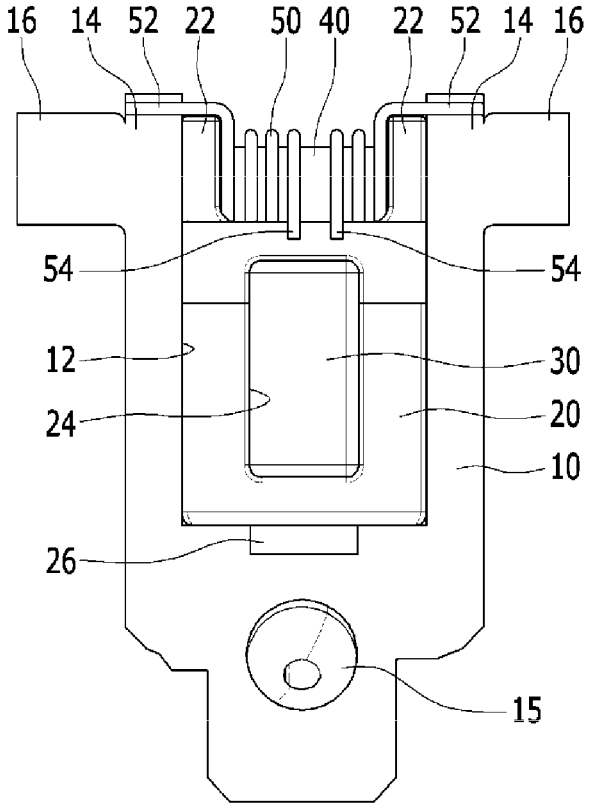
FIG. 2 is a rear view of the exemplary variable valve lift apparatus according to the present invention.

FIG. 1 is a top plan view of a variable valve lift apparatus according to various embodiments of the present invention, and FIG. 2 is a rear view of the variable valve lift apparatus according to various embodiments of the present invention.

As shown in FIG. 1 and FIG. 2, a variable valve lifting apparatus according to various embodiments of the present invention includes an outer body 10, an inner body 20, a roller 30, a connecting shaft 40, and a lost motion spring 50.

The outer body 10 pivots by selectively receiving torque of a camshaft to open/close a valve. A cam is formed or disposed on the camshaft to convert the rotation of the camshaft into the pivot of the outer body 10. The valve is an intake valve or an exhaust valve. A space 12 is formed through the outer body 10 perpendicularly to the outer body 10. That is, the outer body 10 has a predetermined length to pivot and has predetermined width and thickness such that the internal space 12 of the outer body 10 is defined.

The valve is connected to a first end of the outer body 10 and a pivot shaft is disposed at a second end of the outer body 10. The internal space 12 of the outer body 10 is open at the first end, so the outer body 10 can generally have a U-shape.

In the following description, first ends and second ends of the components disposed on or coupled to the outer body 10 mean portions in the same directions as the first end and the second end of the outer body 10.

The inner body 20 is disposed in the internal space 12 of the outer body 10. A first end of the inner body 20 is rotatably coupled to the first end of the outer body 10. Further, it pivots by receiving torque of the camshaft to selectively open/close a valve. A space is formed through the inner body 20, perpendicular to the inner body 20. That is, the inner body 20 has a predetermined length to pivot and has predetermined width and thickness such that the internal space 24 of the inner body 20 is defined.

The roller 30 is disposed in the internal space 24 of the inner body 20. The roller 30 is rotatably coupled to the inner body 20. The roller 30 is in rolling contact with the cam to convert the rotation of the camshaft into the pivot of the outer body 10 or the inner body 20.

The connecting shaft 40 connects the first end of the outer body 10 with the first end of the inner body 20 such that they can rotate. That is, the inner body 20 can rotate about the connecting shaft 40 relative to the outer body 10. The first end of the outer body 10 connected with the inner body 20 by the connecting shaft 40 is referred to as an outer connecting portion 14, and the first end of the inner body 20 connected with the outer body 10 by the connecting shaft is referred to as an inner connecting portion 22.

Valve contact portions 16 protruding from the outer connecting portion 14 are formed at the first end of the outer body 10. The valve contact portions 16 push the valve with the pivot of the outer body 10 in contact with the valve or a valve door for opening/closing the valve.

The outer connecting portions 14 are formed at both sides of the internal space 12 in the width direction of the outer body 10 and the valve contact portions 16 protrude from the outer connecting portions 14 at both sides to close two valves, respectively. A seat where a hydraulic lash adjuster (HLA) is seated is formed at the second end of the outer connecting portion 14. That is, the variable valve lift apparatus according to various embodiments of the present invention is three-point supported variable valve lift apparatus supported by two valves and one hydraulic lash adjuster. The hydraulic lash adjuster, a device that supplies hydraulic pressure to operate a variable valve lift apparatus and allows a valve lifter to move in close contact with a cam, is well known to those skilled in the art, so the detailed description is not provided.

When the inner body 20 is fixed to the outer body 10, the inner body 20 and the outer body 10 pivot together on the pivot shaft of the outer body 10 by rotation of the cam being in rolling contact with the roller 30. When the inner body 20 is unfixed from the outer body 10, only the inner body 20 pivots on the connecting shaft 40 by rotation of the cam being in rolling contact with the roller 30. Selectively fixing and unfixing the inner body to the outer body 10, for example, with a latching pin, are well known to those skilled in the art, so the detailed description is not provided.

The lost motion spring 50 returns the inner body 20 that has pivoted relative to the outer body 10 by pivoting when the inner body 20 is unfixed from the outer body 10

The lost motion spring 50 is wound around the connecting shaft 40.

An outer fixing portion 52 fixed to the outer body 10 and an inner fixing portion 54 fixed to the inner body 20 are formed on the lost motion spring 50. The outer fixing portion 52 may be fixed to the outer connecting portion 14 of the outer body 10, extending in the width direction of the outer body 10 in order to avoid interference with the inner body 20.

Since the lost motion spring 50 is wound around the connecting shaft 40, it can be easily fixed to the inner body and there is no need for a specific component for connecting the lost motion spring 50 to the outer body 10 or the inner body 20. For example, when the lost motion spring 50 is wound around the pivot shaft of the outer body 10 and a portion of the lost motion spring 50 is connected to the inner body 20 through the rotational shaft of the roller 30, the length of the rotational shaft of the roller 30 may be increased and a specific component may be required to wind the lost motion spring 50 around the pivot shaft of the outer body 10.

Figure 3:
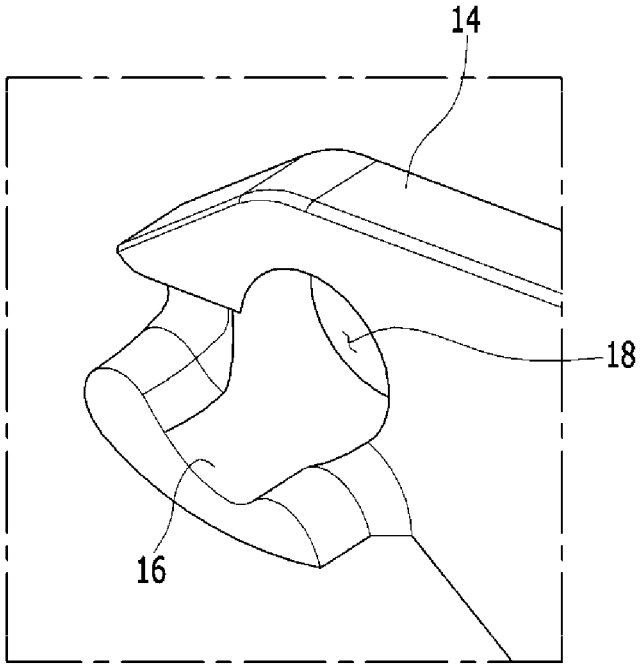
FIG. 3 is a perspective view showing an outer body coupling hole of the exemplary variable valve lift apparatus according to the present invention.

FIG. 3 is a perspective view showing an outer body coupling hole according to various embodiments of the present invention.

As shown in FIG. 1 to FIG. 3, the connecting shaft 40 is disposed through the outer connecting portions 14 of the outer body 10. That is, outer connecting holes 18 are formed at the outer connecting portions 14 of the outer body 10 to receive the connecting shaft 40. Since the valve contact portions 16 protrude from the outer connecting portions 14 to both lateral sides of the outer body 10, the entire width of the outer body 10 except for the valve contact portions 16 and the length of the connecting shaft 40 may be decreased.

Figure 4:
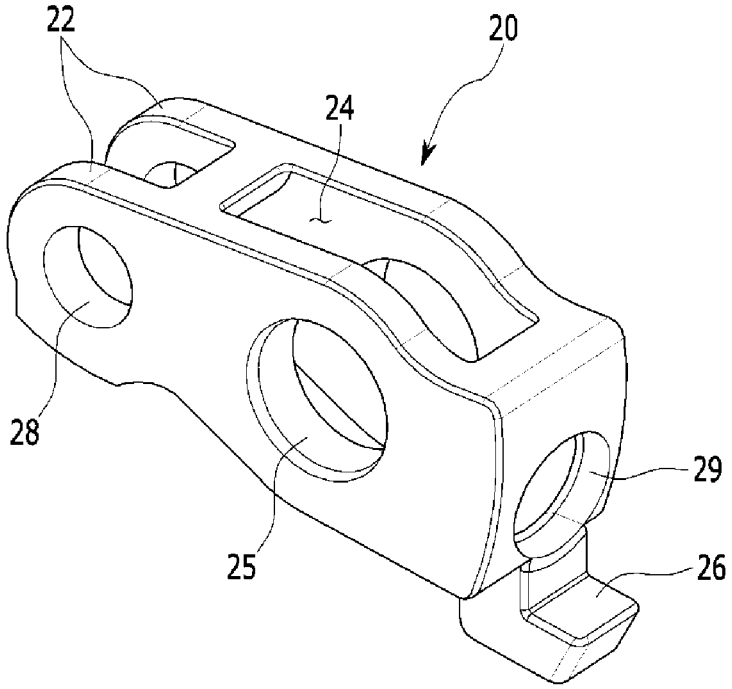
FIG. 4 is a perspective view of an inner body of the exemplary variable valve lift apparatus according to the present invention.

FIG. 4 is a perspective view of the inner body according to various embodiments of the present invention.

As shown in FIG. 4, the inner body 20 further has a stopper 26, inner connecting holes 28, roller holes 25, and a latching pin hole 29.

The stopper 26 protrudes from the second end of the inner body 20, and it locks the second end of the inner body 20 to the second end of the outer body 10 when the inner body 20 is returned by the lost motion spring 50. Accordingly, the inner body 20 can be stably returned by the lost motion spring 50.

The inner connecting holes 28 are formed so that the connecting shaft 40 passing through the inner connecting portions 22 is inserted therein, and the roller holes 25 are formed so that the rotational shaft of the roller 30 is inserted therein. That is, the inner connecting holes 28 and the roller holes 25 are formed in the width direction of the inner body 20.

The latching pin hole 29 is formed so that a fixing member, which selectively fixes the inner body 20 to the outer body 10, such as a latching pin, is inserted therein. As the fixing member is inserted into the latching pin 29 by hydraulic pressure from the hydraulic lash adjuster, the inner body 20 can be fixed to the outer body 10.

Meanwhile, it is possible to precisely optimize a tolerance between the fixing member and the latching pin hole 29 by machining the outer body 10 and the inner body 20 on the basis of the stopper 26.

As described above, according to various embodiments of the present invention, two valve lifts are changed by the roller 30 moving in rolling contact with one cam, such that a loss of power due to friction on the cam can be minimized. Further, since only the inner body 20 pivots with the roller 30 being in rolling contact with the cam, a cylinder can be deactivated. Further, since the lost motion spring 50 is disposed at the valve contact portions 16, the length of the connecting shaft 40 can be reduced and the entire size of the variable valve lift apparatus decreases, so the weight and manufacturing cost can be reduced and the dynamic characteristics can be improved.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus that changes a lift of a valve in an engine, the variable valve lift apparatus comprising:

an outer body selectively pivoting based on a rotation of a cam, having a first end configured to be connected with the valve and a second end mounted with a pivot shaft, and having an internal space formed in the outer body;

an inner body pivoting based on the rotation of the cam, disposed in the internal space of the outer body, and having a first end rotatably connected to the first end of the outer body;

a connecting shaft disposed through the first end of the outer body and the first end of the inner body and connecting the outer body and the inner body to each other; and a lost motion spring having a first portion fixed to the outer body and a second portion fixed to the inner body, wherein the inner body is configured to pivot with the outer body on the pivot shaft of the outer body while being selectively fixed to the outer body, or configured to pivot on the connecting shaft while being selectively detached from the outer body, wherein the lost motion spring returns the inner body that has pivoted on the connecting shaft relative to the outer body, and wherein valve contact portions that protrude from both sides of the outer body in a width direction of the outer body and are configured to come in contact with the valve are formed at the first end of the outer body.

2. The apparatus of claim 1, further comprises a roller that is disposed in an internal space of the inner body, is rotatably connected to the inner body, and is in rolling contact with the cam so that the inner body pivots with the rotation of the cam.

3. The apparatus of claim 1, wherein a stopper of the inner body that protrudes to be locked to the second end of the outer body when the inner body is returned by the lost motion spring after pivoting is formed at a second end of the inner body.

4. The apparatus of claim 1, wherein a portion of the lost motion spring extends without interference with the inner body and is fixed to the first end of the outer body.

5. The apparatus of claim 1, wherein a hydraulic lash adjuster is disposed at the second end of the outer body, and the outer body is configured to be supported at three points by two valves being in contact with the valve contact portions at both sides and the hydraulic lash adjuster.

6. The apparatus of claim 1, wherein the outer body and the connecting shaft are integrally formed, and a portion of the lost motion spring is fixed to the outer body by being fixed to the connecting shaft.

7. The apparatus of claim 1, wherein the lost motion spring is disposed to be wound around the connecting shaft.

8. The apparatus of claim 1, wherein the inner body further includes a stopper, inner connecting holes, roller holes, and a latching pin hole.

* * * * *